US007105734B2

(12) United States Patent
Tucmandl

(10) Patent No.: US 7,105,734 B2
(45) Date of Patent: Sep. 12, 2006

(54) ARRAY OF EQUIPMENT FOR COMPOSING

(75) Inventor: Herbert Tucmandl, Vienna (AT)

(73) Assignee: Vienna Symphonic library GmbH, Vienna (AT)

( * ) Notice: Subject to any disclaimer, the term of this patent is extended or adjusted under 35 U.S.C. 154(b) by 497 days.

(21) Appl. No.: 10/275,259

(22) PCT Filed: May 9, 2001

(86) PCT No.: PCT/AT01/00136

§ 371 (c)(1),
(2), (4) Date: Apr. 1, 2003

(87) PCT Pub. No.: WO01/86624

PCT Pub. Date: Nov. 15, 2001

(65) Prior Publication Data

US 2003/0188625 A1 Oct. 9, 2003

(30) Foreign Application Priority Data

May 9, 2000 (AT) ..... A 810/2000

(51) Int. Cl.
*G04B 13/00* (2006.01)
*G10H 7/00* (2006.01)

(52) U.S. Cl. ..... 84/609; 84/603; 84/615; 84/649; 84/653

(58) Field of Classification Search ..... 84/600–606, 84/609–610, 615, 622–625, 634, 649–650, 84/653, 659–660, 666
See application file for complete search history.

(56) References Cited

U.S. PATENT DOCUMENTS 5,142,961 A * 9/1992 Paroutaud ..... 84/726
5,298,672 A 3/1994 Gallitzendörfer
5,357,048 A * 10/1994 Sgroi ..... 84/645
5,693,902 A * 12/1997 Hufford et al. ..... 84/650

(Continued)

FOREIGN PATENT DOCUMENTS

EP 0237798 9/1987

(Continued)

OTHER PUBLICATIONS

Document entitled "*Das groβe Cubase Handbuch*" by Udo Weyers, 1955, published by GG Gunther Carstens.

*Primary Examiner*—Marlon T. Fletcher
(74) *Attorney, Agent, or Firm*—Greenblum & Bernstein, P.L.C.

(57) ABSTRACT

The invention relates to a novel array or piece of equipment (100) for providing assistance while composing musical compositions at least by means of acoustic reproduction during and/or after composing musical compositions or the like which are played on virtual musical instruments, preferably in a light music ensemble. Said array or piece of equipment comprises a composing computer (100) having at least one processor unit (4), at least one sequencer (5) that is data-flow connected to the latter and at least one sound sample library storage unit (6*b*) that is data-flow and data-exchange connected to at least said units (4,5). In order to manage the sound samples (61) stored in the above-mentioned storage unit (6*b*), a bidirectional sound parameter storage unit (6*a*) is provided, which is bidirectional or multitdirectional data-flow and data-exchange connected at least to the processor unit (4) and to the sequencer (5). Each of the sound samples (61) stored in the sound sample storage unit are assigned to said bidirectional sound parameter storage unit, which contains sound definition parameters enabling access to sound samples (61).

20 Claims, 2 Drawing Sheets

U.S. PATENT DOCUMENTS

| | | | | | |
|---|---|---|---|---|---|
| 5,728,960 | A | | 3/1998 | Sitrick | |
| 5,763,800 | A | * | 6/1998 | Rossum et al. | 84/603 |
| 5,783,767 | A | * | 7/1998 | Shinsky | 84/657 |
| 5,886,274 | A | * | 3/1999 | Jungleib | 84/601 |
| 5,986,199 | A | | 11/1999 | Peevers | |
| 6,022,229 | A | | 2/2000 | Nishimura et al. | |
| 6,124,543 | A | * | 9/2000 | Aoki | 84/609 |
| 6,150,598 | A | | 11/2000 | Suzuki et al. | |

FOREIGN PATENT DOCUMENTS

| | | |
|---|---|---|
| EP | 0899892 | 3/1999 |
| EP | 0907160 | 4/1999 |
| FR | 2643490 | 4/1990 |

* cited by examiner

ARRAY OF EQUIPMENT FOR COMPOSING

CROSS-REFERENCE TO RELATED APPLICATIONS

The present application is a U.S. National Stage of International patent Application No. PCT/AT01/00136 filed May 9, 2001 and claims priority of Austrian Patent Application No. A810/2000 filed on May 9, 2000.

BACKGROUND OF THE INVENTION

1. Field of the Invention

The invention relates to a new arrangement or system for composing—e.g., supported by the acoustic playback during and/or after the completion of a musical composition—tones, tonal sequences, tone clusters, sounds, sound sequences, sound phrases, musical works, compositions or the like and for the acoustic, scored or other playback of the same, that can be played on and rendered by preferably a plurality of virtual musical instruments corresponding to real musical instruments and providing their tones or sounds, preferably in an ensemble formation such as, e.g., in chamber music, orchestra formation or the like.

2. Discussion of Background Information

The following should be explained about the printed publications concerning the background of the prior art in this field:

EP 0899 892 A2 describes a proprietary extension of the known ATRAC data reduction process as used, e.g., on minidisks. This document discloses nothing more than that the invention described there—like many others—is concerned with digitally processed audio.

U.S. Pat. No. 5,886,274 A describes a proprietary extension of the known MIDI standard which makes it possible to connect sequencer data, i.e., playing parameters of a piece of music, with sound data such that a platform-independent parity of the played back piece is guaranteed. It primarily concerns a distribution of MIDI and meta data over the Internet that is as consistent as possible.

A data-related mix of play and sound parameters is provided there. The sound production is conventional in its approach (see FIG. 1). The output devices are merely the objective, but not the source in the flow chart. A feedback loop as regards content from the synthesizer to the sequencer is not rendered possible.

FR 2 643 490 describes a method for computer-aided music notation-nowadays technically already realized in many cases in a similar way or developed much further; the computer-based notation is naturally a necessary feature, but one that is limited there to the three meters 4/4, ¾ or 2/4 (compare FIG. 4, center).

U.S. Pat. No. 5,728,960 A describes the problems and possibilities for realization of computer-aided note display and transformation, primarily with regard to contemporary rehearsal and performance practice. "Virtual sheets of music" are thereby produced in real time. In "Conductor Mode" the possibility of a processor-aided processing of a video recorded conducting against a blue screen (see FIG. 9) is considered. There is no reference at all to a virtual/synthetic realization from an intelligently connected sound database.

U.S. Pat. No. 5,783,767 A describes the computer-aided transformation of the control data of a melodic input to a harmonic output—it possibly refers to a logic on which an automatic accompaniment is based, but no bi-directional connection between musical/compositional input and sound result is provided or at least considered there, either. The "Easy Play Software" entry in FIG. 15 also indicates this in particular.

SUMMARY OF THE INVENTION

The following is provided by way of introduction to the facts on which the present invention is based:

The present invention makes possible the production of high quality, in particular symphonic compositions, i.e., in particular soundtracks for films, videos, advertising or the like, or contemporary music, despite declining budgets.

Recordings with real orchestras, which cost between, e.g., ATS 350,000 and 750,000, have not been hitherto possible because music budgets for Austrian or other national film productions are in the range of ATS 100,000 to ATS 250,000. For this reason, the sampling Musical Instruments Digital Interface (MIDI) technology has largely been used in this field for several years now. The so-called Miroslav Vitous Library, for instance, can thus be consulted for virtual orchestral compositions. This "library" comprising 5 CDs is per se the most comprehensive and at the same time most expensive "orchestra sound library" currently on the market. It offers 20 different instruments or instrument groups with an average of five playing styles per instrument. The results thereby achieved are very convincing if one adjusts during composition to the limited possibilities of this library. From the point of view of an artist, however, it is unsatisfactory to have the very restricted range of the available sampler function as it were as co-composer, since an unrestricted implementation of compositional ideas usually leads only to more or less unsatisfactory results with the "libraries" available today.

As relevant experience has shown, the above-referenced budget problems are by no means specific to Austria. Nowadays most international film productions are also forced to work with limited film music budgets.

There is also the fact that film productions already have problems keeping to calculated budgets during filming and, since music production falls within the field of post-production, that is where cuts are inevitably made.

Many composers try to solve this problem by using either "synthesizer soundtracks" or chamber music arrangements. However, the broad emotional spectrum of an entire orchestra is often the only way to actually adequately back up the emotional content of films, as well as other fields, too. In such cases so-called Classic Sample Libraries are used, such as, e.g., those of Vitous, Sedlacek or Jaeger.

The highest precept when working with "sampled instruments" is "the instruments (orchestra) have to sound genuine." Exceptions to this rule relate to a deliberate artifice, which of course can also be intended within the concept of a composition.

If the above-referenced precept is not adhered to, such a composition, or its playback, is referred to by the scarcely flattering term "plastic orchestra."

In order not to produce such "plastic sounds," the present invention provides remedy. The development of technical possibilities, in which the available sound libraries all lag behind, has given rise to the need for a new, comprehensive "orchestra library" which uses the standard currently achievable and possible in this field today or in the foreseeable future.

Before the invention is described in detail, here is a brief outline of the new "sampling technology" on which it is based:

In the broadest sense a sampler is a virtual musical instrument with stored tones that can be selectively retrieved and played.

The user or composer loads the required sounds, i.e., tones, notes or the like, into the working memory of the sampler from a data storage medium, such as, e.g., a CD-ROM or hard disk.

This means, e.g., a tone- or sound library, a so-called "sample library" was made of a piano, it was thereby recorded tone for tone and edited for the sampler. The user can now play back the tones of a real piano, ideally 1:1, i.e., realistically, on a MIDI keyboard or from the recorded MIDI data in a MIDI sequencer.

When appropriate classical samples, i.e., classical sound material, is/are available, it is possible only in the ideal case to play back a classical score previously stored by means of conventional, thus, e.g., by means of MIDI programming, with ultimately orchestral quality.

The decisive features here are the quality and the range of the recorded and stored sounds and their careful editing and furthermore in particular the digital resolution format. The not very satisfactory material currently available is recorded in the previous 44100 kHz/16 bit resolution technology. However, the technology in this sector is moving very rapidly in the direction of 96000 kHz/24 bit resolution.

The higher the resolution, the more convincing the audio impression.

The present invention provides an arrangement or system as defined at the outset for composing possibly assisted by acoustic playback during and/or after completion of a musical composition, characterized in that The notation entry unit of the arrangement or system is data flow and data exchange- connected and networked via at least one interface, preferably a Graphical User Interface, to a composition computer, which comprises At least one processor unit, and At least one sequencer unit, data flow- and data exchange-linked with the processor unit (CPU) that can be provided with the said notes, note sequences, note clusters and the like together with the sound definition parameters respectively assigned to them or with the sounds, sound sequences, sound clusters and the like corresponding to the same, and that can store these to be retrievable consistent with an input-related sequence and transmit them via at least one corresponding interface to a monitor speaker, to a speaker or the like, to a score printer or the like, and furthermore At least one sound sampler unit data flow- and data exchange-connected to the said processor unit and to the said sequencer unit.

The sound sampler unit in turn comprises

At least one sound sample library memory unit containing in memory the recorded sound images or sound samples available in digitalized or other form of all the individual sounds, sound sequences, sound clusters and the like of the individual virtual instruments or instrument groups, and At least one bi-directional sound parameter memory unit or "relational sound parameter database", data flow- and data exchange-connected to the same, and storing and administering each of the said sound samples in the form of sound definition parameters assigned to the same and describing or defining the same, e.g., in the form of combinations or sequences of the same, provided for the retrieval of the sound samples from the sound sample library memory unit and for a transmission of the same at least to the processor unit and/or sequence unit and/or for the storage, administration and transmission of sounds/sound sequences/sound clusters or the like changed by processing in their quality and thus in their sound definition parameters in the composition computer or described with sound definition parameters newly entered in the same.

The following is pointed out by way of explanation regarding the terms and expressions used above:

Note or tone sequences or the "sound sequences" corresponding to them refer to musical segments with several notes or tones or sounds to be played one after the other, "sound sequence parameters" refer to the respectively desired playing style of the sound sequence. A brief outline follows of what is meant by this. In the auditory impression there is a difference in how, e.g., three virtual legato individual tones or sounds played one after the other sound which are based on the digital recording of tones or sounds played individually on a real instrument, from when the virtual tonal sequence is based on a tonal sequence played on a real instrument. Note cluster or sound cluster refers to a number of more than one notes or sounds played on an instrument at the same time or the sounds corresponding to them, thus, e.g., a triad, associated "sound cluster parameters" would be, e.g., the "arpeggio" playing of a description parameter defining a triad. The conjunction "and/or" refers to individual sounds, sound sequences and sound clusters individually or in any respectively desired combination, e.g., a sequence of arpeggio chords played fast legato or the like. In order to avoid this cumbersome circumlocution, in the following the abbreviated term "sound definition parameter" or often for simplicity's sake merely "parameter" is used.

The bi-directional sound parameter memory unit integrated into the new composition computer or the software on which it is based represents an essential core of the invention; it is essentially a search engine interposed between the entry and control unit and the sound sample library memory unit, i.e., the sound sample database, for the sounds, sound sequences, sound clusters and the like stored in large number in the memory unit as sound images, or sound samples, e.g., defined by means of digitalized sound envelopes.

The new system and its technology makes it possible for the first time to provide the composer who has no opportunity to work with a real orchestra and/or real instrumentalists, with an extremely user-friendly tool that is no longer burdens his work with coding or the like, the sound of which produced by him approximates most closely the sound of a genuine orchestra.

The main advantages of the invention in its basic concept and their variations are as follows:

It allows a clear handling of the various "instruments" and their playing variants which does not interfere with intuition. For the first time a processing interface is available to the user, i.e., the composer, that corresponds to the orchestra scores customary in practice. It provides an opportunity of working in a "linear" manner, that is on only one track, despite hundreds of playing variations of a respective individual instrument.

The invention also makes the work easier by optimal, independent, "intelligent" background processes, such as, e.g., automated time compression and expansion with tonal sequence samples, such as repetitions, legato phrases, glissandi or the like.

It makes it possible to have a complete overview of an already completed tone or note sequence, the instrumentation, etc. at all times in the course of or during the progression of the compositional process and also to get information immediately on a just entered note and its parameters determining the sound, whereby immediate, visual and—which is particularly important for musical composition—direct acoustic monitoring is ensured by an acoustic playback system as monitor speaker.

The sound samples of the sequencer unit organized in the form of the bi-directional database transmits its qualitative parameters anew and above all always updated in the form of "sound sample description parameters" at each work session, and thus renders possible the bi-directional and interactive reference to sequencer unit and sound sample library memory unit.

The present invention is also directed to simplified embodiment of the new system [is the subject matter of claim 2].

As far as the "inner organization" of the composition system according to the invention is concerned, a software of the bi-directional sound parameter memory unit with a main track/subtrack hierarchy of the instruments is favorable, whereby a structuring of the subtracks in levels can provide its special services.

Preferably in particular a configuration can be provided in which, in the bi-directional sound parameter memory unit, the sound definition parameters are configured or structured according to a hierarchical principle, e.g., instrument level (Ei)—instrument modus level (Em)—instrument playing styles level (Es)—first to nth playing style sublevels (Es1, Es2, . . . , Esn)—sound lengths level (El)—sound pitch level (EU) etc. (example El: violin—Em: senza sordino—Es: arco—Es1: legato—Es2: medium vibrato—Es3: . . . , Es (n-1): quarter note—Esn: entered a).

Furthermore, it can be advantageous to configure the tones, tonal sequences, tone clusters and their parameters in the sampler database with equal value and parallel, but to provide a hierarchical structure within the same.

With regard to a convenient work flow for the composer, arranger or the like, it is advantageous for the composition computer to include a score software.

If a software for the tone or sound range of an instrument or for its definition is alternatively or additionally integrated into the computer, which upon composition of a tone that cannot be played on the respective instrument, this ensures the composer is alerted accordingly, this implements an important step for comfort and effective work.

In order to expand the spectrum of the sound effect of the instruments or instrument groups or the entire virtual orchestra, e.g., for the playback of various "types" of harmonic fusion, thus, e.g., in order to give this orchestra the audio impression of different venues, concert halls, churches, possibly open air spaces or the like, furthermore different placements of the instruments there, locations of the listener, shrill or soft sound effect, it is particularly advantageous if a corresponding sound (post) processing software is integrated into the composition computer. In this regard, it is particularly advantageous for a specific selection of dynamics to provide a corresponding software unit alternatively or additionally.

For a playback of a composition that virtually fully corresponds to the reality of listening to rapid tone repetitions and fast legato tonal sequences, appropriate alternative or additional software units can be used in the first embodiment disclosed there.

A problem that occurs with often disruptive effect particularly with virtual instruments or their playback quality is caused by the different volumes and volume ranges of the various real instruments whose sounds are stored in the sound sample library. When different types of instruments are played together in a formation, the instruments with louder volumes overwhelm the instruments with lower volume levels. This problem can likewise be dealt with by using another preferred software provided alternatively or additionally which permits a volume adaptation or adjustment, so that, if desired, the natural dynamic differences between the "loud" and the "soft" instruments are retained. Of course, with a system equipped in this way, even an "inversion" of the volumes to produce exotic sound effects can be produced.

As the previous explanations have shown, the present invention is based on a comprehensive, digitalized collection or library of recordings of the sounds of real orchestral instruments. These recording samples are organized or administered by the bi-directional sound parameter memory unit or relational sound database representing the core of the invention, which renders possible a qualitative connection between them as well as with the notation entry unit and/or sequencer unit acting as a control unit. This new type of bi-directional connection makes it possible both during the compilation as well as during the simultaneous or delayed playback of a musical work, not only to transfer control data from the referenced control unit to the sound generation, but also further permits the interactive feedback of information from the sampler unit to the referenced control unit.

Whereas with a hitherto customary MIDI sequencer/sampler combination, the user himself has to ensure that, e.g., a certain MIDI command also produces the desired sound result, the system on which the device according to the invention is based ensures in a completely new way an immediate selection that is correct as regards content on the basis of the features or parameters of the individual samples available in the sound sample memories (sound sample definition or sample description parameters) stored in the bi-directional memory and transmitted from there. This therefore directly ensures that, e.g., an indicated G of a violin, mezzo forte, bowed, solo, etc. is also actually rendered as such. The possibly conceivable objection that something similar might also be possible via laboriously programmed MIDI program change commands, goes nowhere because a conventional MIDI sequencer is absolutely unable to receive a qualitative checkback signal on the available sound data.

Furthermore, the interactive feedback loop between the control unit and sound generation provided in the system according to the invention for the first time, renders possible the sensible use of phrase samples: Since because of the parameters transmitted by the sample memory database the sequencer unit can alternatively retrieve appropriate complete musical phrases—such as repetitions or quick, legato runs—instead of sampled individual notes, these can actually be realistically simulated for the first time. The integral connection within the new arrangement further permits the automated use of DSP-aided processes, such as, e.g., time-stretching, in order to, e.g., adapt phrase samples to the tempo of the composition, etc.

The qualitative parametering of the sound database by means of the new bi-directional sound parameter memory unit also further permits a future addition to the available instruments, e.g., of ethnic instruments or instruments of ancient music, without the control unit losing any functionality, since the sound parameter database is able to transmit its—then expanded—features to the said control unit at the latest in the course of the system's next start routine.

The large number of combinations of parameters which can be assigned to an individual violin tone or sound and which ultimately define it close to audio reality, is shown by way of example and without any claim to completeness:

| Number of variants: | | |
|---|---|---|
| 1. | Arrangement: e.g., unison combinations, thus, e.g., 1, 4 or 10 violins | 3 |
| 2. | Main playing style: with or without mute | 3 × 2 = 6 |
| 3. | Playing style, e.g., bowed, plucked, tremolo, etc. | 6 × 6 = 36 |
| 4. | Subordinate playing style, e.g., bowed, soft, hard, short, in a burst, etc. | 36 × 4 = 144 |
| 5. | Nuances, e.g., much vibrato, little vibrato | 144 × 2 = 288 |
| 6. | Dynamic gradations (assuming 3 gradations) | 288 × 3 864 |

This means that 864 variants are available for a single tone, thus 864 sampler rows: with the tonal range of the violin of 22 tones, this ultimately results in 22×864=19008 individual samples, and this is still without sample sequences, such as repetitions, fast legato phrases or the like.

This large number of sounds urgently required the adaptation of the previously available sampler and the MIDI technology hitherto used, so that the composer no longer has to deal with the enormously high number of sample data and their modifications individually and directly.

The essence of the invention lies in treating the samples as the smallest elements of a sample library, which is directly connected to the sequencer and the processor unit. This means that the sequencer software on which the sequencer unit is based experiences the describing parameters of each sample in the course of the startup (booting) sequence and makes them available to the user in a structured manner in the further course of a work session.

Thus, if the user composes, e.g., notes on one "track" for a trumpet, e.g., only more samples from the "Trumpet" sample library section are possible. If he assigns the dynamic label "piano" to the notes, only more "trumpet piano samples" can be used, etc.

The connection criteria can be defined by the individual sample name and, e.g. without any restricting effect, be structured as follows:

| "Vn10SsALVmC4PFg2" means | | | |
|---|---|---|---|
| Vn | Violin group | C | crescendo |
| 10 | Ensemble with 10 violins | 4 | 4 s in length or duration |
| Ss | Senza sordino | P | starting dynamic: piano |

-continued

| "Vn10SsALVmC4PFg2" means | | | |
|---|---|---|---|
| A | Arco | F | Ending dynamic: forte |
| L | Legato | g2 | pitch |
| Vm | Vibrato medium | | |

The following partial example serves to explain the invention in more detail and shows only a few essential possibilities and variants out of the abundance of the available range, which have only been made possible at all through the bi-directional database-linked sampler sequencer technology according to the invention:

PARTIAL EXAMPLE

The concept on which the software of the sequencer unit is based is explained on the basis of the following example, whereby the sample library, i.e., database is assigned its own track classes.

| There are e.g., 13 manufacturer-preset main tracks: |
|---|
| 1. Flutes |
| 2. Oboes |
| 3. Clarinets |
| 4. Bassoons |
| 5. Trumpets |
| 6. Horns |
| 7. Trombones |
| 8. Tubas |
| 9. Strings |
| 10 Choir |
| 11. Kettledrums |
| 12. Percussion |
| 13. Harp & bar chimes |

In a graphics editor the composer generates instrument subtracks (IST) from the main track (HT), for the strings, e.g., a standard preset would be as follows:

1. "Initial example" Quarter note=110 (tempo)

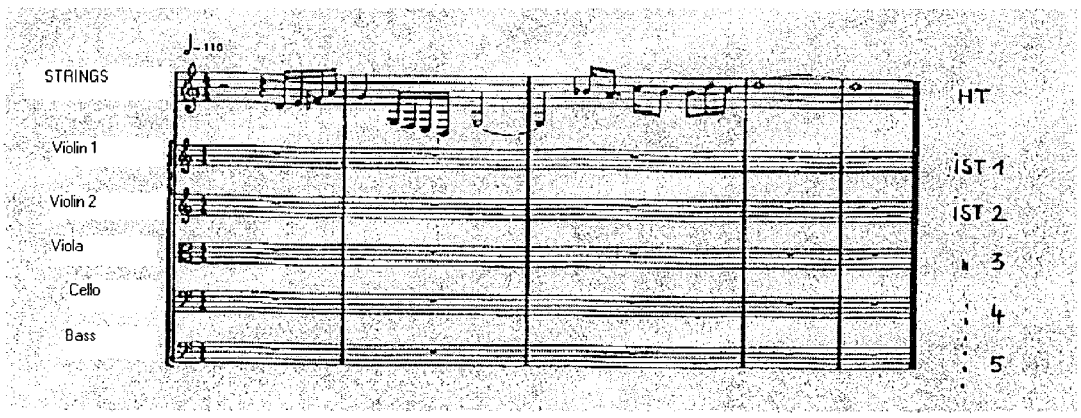
STRINGS
Violin 1
Violin 2
Viola
Cello
Bass
HT
IST 1
IST 2
3
4
5

Depending on the desired instrumentation, the notes of the main track (HT) are assigned to the respective instrument subtrack (IST). Of course, a composed tonal sequence can also be directly played or imported into the instrument subtrack, as shown above.

In this example the note (rest) sequence of the STRINGS main track (phrase) is assigned to the instrument subtrack violins 1.

The sound parameter unit now automatically accesses only the violin samples of the sample library—a flag and a notation can alert the composer when certain tones composed by him lie outside the natural range of the selected instrument.

If you now click on a note, a main menu appears with the following points:

(subtrack 1, violin 1, quarter note=110)

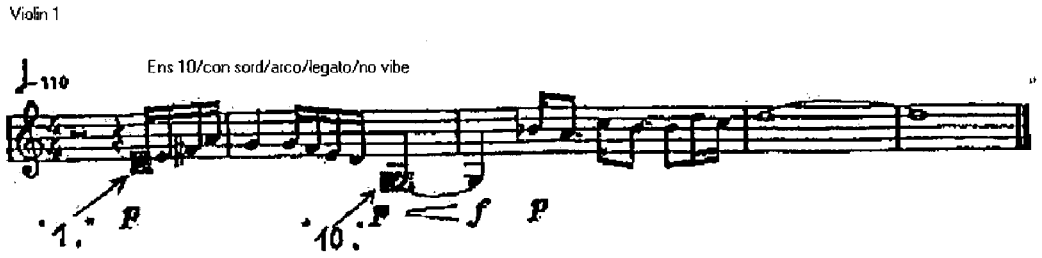
Violin 1
Ens 10/con sord/arco/legato/no vibe
110
1.
p
10.
p
f
p

This subtrack 1 (IST 1) line features the same note sequence as above in the STRINGS main track (HT), however, notes that are "too low" are labeled as such by a tonal range software of the computer, e.g., by underlining or the like, since they are not playable, see parentheses above.

For the first note of the above "note sequence" the following appears, for example, on the monitor under the line of notes:

Main Menu
Instrument parameter
Dynamics
Repetition detector
Fast legato detector
Special features The possible arrangement, manner of playing and phrasing styles of the subtrack 1 instrument can be defined with the (main) menu line "instrument parameter." This menu follows the principle of a data tree and is individually structured for each instrument. This menu is ultimately determined by the sound sample definition parameters or sample description parameters—hereinafter often simplified as sound parameter or merely as "parameter"—transmitted by the database.

With the violins, this structuring can have, e.g., the following form:

| MAIN MENU<br>Instrument parameter | 1ST LEVEL<br>10 violins | 2ND LEVEL<br>Senza sordino | 3RD LEVEL<br>Arco | 4TH LEVEL<br>Legato | 5TH LEVEL<br>Medium vibrato |
|---|---|---|---|---|---|
| Dynamics<br>Repetition detector<br>Fast legato detector<br>Special features | 4 violins<br>Solo violin 1<br>Solo violin 2 | Con sordino<br>Senza sordino<br>Con sordino<br>(Possibly further creations by the user) | Tremolo<br>Glissando<br>Pizzicato | Marcato<br>Detaché<br>Staccato<br>Trills<br>Suggestions | Senza vibrato<br>Strong vibrato<br>Espressivo<br>Cantabile |

Three further examples II through V are provided:

II.

| 3RD LEVEL | 4TH LEVEL |
|---|---|
| Arco | |
| Tremolo | Medium vibrato |
| Glissando | Strong vibrato |
| Pizzicato | |

III.

| 1ST LEVEL | 2ND LEVEL | 3RD LEVEL | 4TH LEVEL | 5TH LEVEL |
|---|---|---|---|---|
| (Arrange-ment) | (change in the instrument) | (bow technique) | | |
| 10 violins | Senza sordino | Arco | Legato soft | 1st note down-bow |
| 4 violins | Con sordino | Tremolo | Legato | 1st note up-bow |
| Solo violin 1 | Senza sordino | Glissando | Marcato | Only down-bow |
| Solo violin 2 | Con sordino | Pizzicato | Detaché staccato Trills Suggestions | Only up-bow |

-continued

IV.

| 1ST LEVEL | 2ND LEVEL | 3RD LEVEL | 4TH LEVEL | 5TH LEVEL |
|---|---|---|---|---|
| 10 violins | Senza sordino | Arco | Legato | Semitone |
| 4 violins | Con sordino | Arco/sul G | Marcato | Whole tone |
| Solo violin 1 | Senza sordino | Tremolo | Detaché | Minor third |
| Solo violin 2 | Con sordino | Glissando | Staccato | Major third |
| | | Pizzicato | Trills | Fourth |
| | | | Suggestions | |

The advantage of the described new type of organization in levels of the bi-directional sound parameter memory unit in the device provided according to the invention is that no double-tracking occurs but instead, after selecting a certain line in a certain level only more of that selection of possibilities is offered in the next level, which corresponds to the clicked line of the previous level and not selections that are not possible at all for this line.

With this type of structuring or hierarchy attention is paid from the start to individual characteristics and structures of each of the instruments or instrument groups and the composer is straight away offered only more of those variables that the respective instrument or the respective group of instruments is capable of offering.

It is therefore no longer necessary to always select right up to the end of the data tree; the highest level is always the basic concept. If a certain playing style is selected, the selection made appears immediately afterwards, e.g., underlined, in bold type, or the like in the menu bars, at the same time this term appears automatically above the first selected tone or sound and/or as phrasing sign above the notes. If the playing style is to be changed from a certain note onwards, thus, as, e.g., in examples II through V from Arco to pizzicato (3rd level), all the levels below must be redefined, but the ones above are retained, thus, e.g. "10 violins, senza sordino" are retained for example IV.

V

An example of another structuring of the instrument parameter menu would be as follows for the kettledrum:

| MAIN MENU | 1ST LEVEL | 2ND LEVEL | 3RD LEVEL | 4TH LEVEL |
|---|---|---|---|---|
| Instrument parameter | Bass kettledrum | Sm. Felt drumsticks | Normal | Semitone |
| Dynamics | High A kettledrum | Lg. Felt drumsticks | Tremolo | Whole tone |
| Repetition detector | Octave kettledrum | Sm. Soft Flannel drumsticks | Secco | Minor third |
| Fast legato detector | Optimized kettledrum | Lg. Soft Flannel drumsticks | Glissando up | Major third |
| Special features | | | Glissando down | Fourth |
| | | | Tremolo gliss. up | |
| | | | Tremolo gliss. down | |

Optimized kettledrum selection: each of the kettledrums listed in the 1st level comprises a certain tonal range, partially overlapping with the range of another kettledrum. If, for example, the bass kettledrum is assigned a tone too high for it, a software ensures a warning appears on the screen, as explained above in the tonal range instruments assignment.

Certain tones overlap on the various types of kettledrum. If for example a kettledrum tone with the pitch "A major" is selected during composition, this tone can be played on the bass kettledrum, on the large concert kettledrum and on the small concert kettledrum. Here help is provided by a line and a corresponding software-aided option: "optimized kettledrum selection." This ensures that for each of the kettledrums precisely the best sounding tonal range is used.

Since the various playing styles on levels 3 and 4 apply to all kettledrums and all types of drumstick and therefore feature identical, database structures, it is possible with an edited kettledrum part, for instance, to alternate without any difficulty between the drumstick types of level 2 in order to find the most suitable variant from the point of view of the audio impression.

Dynamic Software

Back to the initial example with 10 violins:

The violins are defined by "10 violins, con sordino, legato, without vibrato" and now the dynamics are assigned:

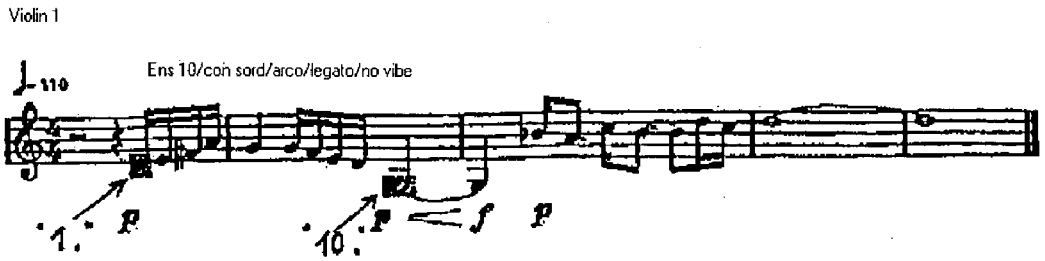
Violin 1
Ens 10/con sord/arco/legato/no vibe
110
1.
p
10.
p
f
p

A main menu appears for each note, as shown below, thus, e.g.:

| 1st note: d: | MAIN MENU | 10th note: G | MAIN MENU |
|---|---|---|---|
| | Instrument parameter<br>Dynamics<br>Repetition Detector<br>Fast Legato Detector<br>Special Features | | Instrument parameter<br>Dynamics<br>Repetition Detector<br>Fast Legato Detector<br>Special Features |
| | 1ST LEVEL | | 1ST LEVEL |
| | static<br>progressive<br>Free | | static<br>progressive<br>free |
| | 2ND LEVEL | | 2ND LEVEL |
| | ppp fff<br>pp ff<br>p f<br>mp mf | | START END<br>ppp fff ppp fff<br>pp ff pp ff<br>p f p f<br>mp mf mp mf |

The first note, i.e., d, is selected and the dynamic is chosen from the main menu. A data tree structure leads in turn to the various options:

In the first level, "static" is selected, in the $2^{nd}$ level "piano." This entry now applies to all the following notes until the next entry. Now the $10^{th}$ note of the piece, i.e., G, is selected, progressive is selected in the $1^{st}$ level and in the $2^{nd}$ level the start and end dynamic are set.

Now for the first time the composition computer uses an automated "compression expansion tool" or the corresponding software; i.e., the "10 violins/con sordino/senza vibrato/crescendo/Start p-end f" samples.

These are contained in the sampler database, e.g., in 4 lengths, i.e., with durations of 4 s, 2.66 s, 2 s, 1.33 s; of the selected note G, thus a half+a quarter=three-quarter note at tempo 110 has a length of 1.63 s.

The said software automatically recognizes by the sound definition parameter or the sample description parameter the best or nearest suitable sample with a length of 1.33 s and stretches it by the corresponding factor of 1.226, so that 1.63 s is achieved for the said $10^{th}$ ¾ note. This process runs in the background in a software-controlled manner and goes unnoticed by the system user.

If a dynamic change is desired, which is not preset in the database for certain instruments in a defined playing style, e.g., "violins tremolo, sul ponticello, ppp-fff," the computer or its corresponding software selects the most suitable, that is, the closest sample "crescendo pp-ff" and intensifies it with an automatically inserted main volume curve.

After this above-mentioned "crescendo" the dynamic f is assigned to all the following notes in the example. However, if the composer afterwards wants to return to, e.g., the dynamic p, he has to redefine this value for the corresponding following note.

Finally, a likewise favorable "dynamic-free parameter" will be explained:

This is a software function for tones "held" (for a long time) with several dynamic changes:

A tonal sequence is given in the following line of music, the last two notes form two whole notes "held" over two 4/4 bars:

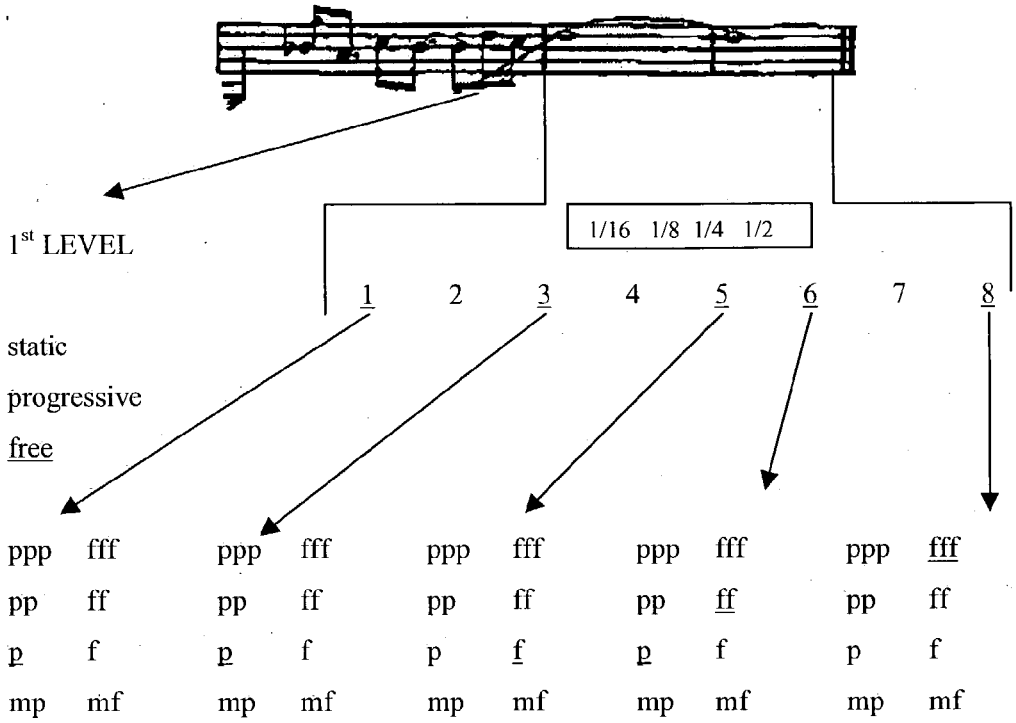
1st LEVEL
1/16 1/8 1/4 1/2
1 2 3 4 5 6 7 8
static
progressive
free
ppp fff ppp fff ppp fff ppp fff ppp fff
pp ff pp ff pp ff pp ff pp ff
p f p f p f p f p f
mp mf mp mf mp mf mp mf mp mf The desired tone of the example is selected: thus a long tone "held" over two 4/4 bars. After this, the program function "dynamic/free" is activated by clicking. The time grid shown above appears under the long note d, which divides the tone length into 8 units, in the present case into 8 quarter notes. The user has the options "more detail" or "less detail" and can thus show the time grid in lower "half note resolution" or higher "eighth note resolution."

He can further select from a list the known static-dynamic expression mark (from ppp to fff). He now places the mark p, for instance, on the first and third grid point, i.e., the numbers 1 and 3 of the time grid; the tone is thus piano up to the $3^{rd}$ quarter note, if the mark f is placed on the $5^{th}$ grid point, then a crescendo results over two quarter notes to forte on the one of the 2nd bar and a p on the $6^{th}$ grid point, thus quasi an "fp effect" and finally on the last grid point an fff: there is a strong crescendo over the length of the last three quarter notes. With the aid of the compression expansion tool and a crossfade tool the sequencer now generates a new sample with the relevant sample description parameter set. (This new sample is optionally deleted at the end of the work session or permanently stored in the relational database and made available at further work sessions.)

The following picture shows the line of music and the dynamic marking p<fp<fff under the held note:

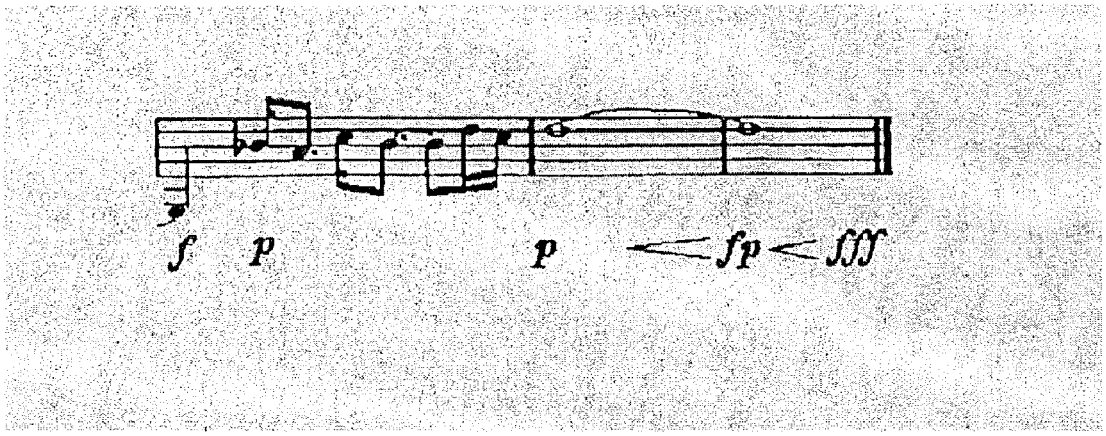
f
p
p
fp
fff

Assumption: A trumpet passage has already been provided with appropriate phrasing and dynamic markings:

Trumpet 1:

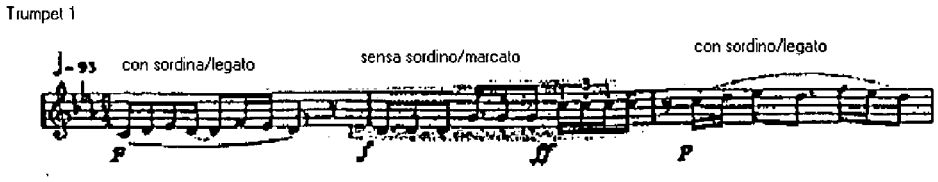
| MAIN MENU | $1^{ST}$ LEVEL |
|---|---|
| Instrument parameter | automatic |
| Dynamics | manual |
| Repetition Detector | |
| Fast legato Detector | |
| Special features | |

Assumption:

The line of music in this example contains respectively three times three tones of differing pitch, whereby for each of the three tones respectively the same tone is played three times in succession, which represents very typical repetitions for trumpet fanfares. Such repetitions normally form a severe weak point of all previously known and available programs. In those, there is always only one sample that is suitable for such a repetition, and this is repeated the correspondingly required, i.e., composed number of times. The more frequently and rapidly this tonal sequence is sounded, the more stuttering and artificial the audio impression. For this case, the sample library organized according to the invention provides "repetition samples." They are, e.g. 2-, 3-, 4- and 6-fold repetitions, or 1-, 2-, 3-fold upbeat repetitions, differentiated in tempo, dynamic and stress.

The principle of repetition detection is something like that of a spell checker of a word processing program:

The user selects the range of the note repetition which he wants to supply with repetition samples and then selects from the main menu the $3^{rd}$ entry shown above "Repetition Detector." A submenu permits a choice between automatic, i.e. manufacturer-preset, or manual. In the manual mode a sequencer program analyses the selected range and characterizes the possible repetition sequences, following line of music:

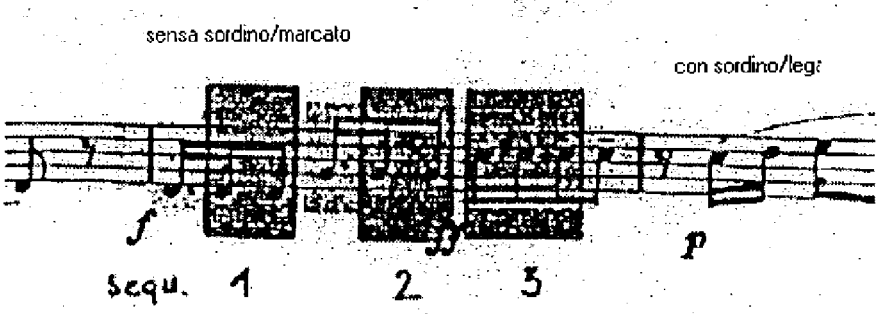
sensa sordino/marcato
con sordino/leg
f
p
Sequ. 1
2
3

| | |
|---|---|
| Sequence no.<br>Sequence 1 of 3<br>Repetition plays<br>Original plays<br>Alternatives<br>Next sequence<br><br>With the original and repetition clicks one can control the obtained result by comparison. With the alternatives click one can try to further optimize the result | Sequence no.<br>Sequence 1 of 3<br>Faster fixed 1st note<br>Faster fixed last note<br>Shorter notes<br>Longer notes (1)<br>Expression on notes 1-2 (2)<br>"Faster-slower" gives the sample (with the aid of the compression-expansion tool) a certain groove, it begins either somewhat too late or ends somewhat too early, as selected.<br>(1) "Shorter-longer" replaces the sample either with tenuto or staccato samples<br>(2) "Expression on note 1" (2, 3, 4) exchanges as selected the sample with a sample of appropriate accentuation, which depends on the number of repetitions. |

The rapid succession of legato tones represents a problem similar to repetitions. No convincing, fast legato playing can be simulated by means of individual tone samples. Here the sample library provides a construction set of 2-, 3- and 4-fold tone sequences. With instruments with fast legato samples, these can be about 500–2500 individual sample phrases: chromatic, diatonic tonal sequences and triad analyses.

The original tempo of these sampled legato phrases stored in the computer or the sound sample memory are, e.g., $16^{th}$ note values at tempo 160. With the aforementioned compression-expansion tool, eighth triplet passages can consequently be transposed in a tempo of 171 to 266, $16^{th}$ passages in a tempo of 128 to 200, $16^{th}$ triplet passages in a tempo of 86 to 133, $32^{nd}$ passages in a tempo of 64 to 100. (Quintuplets and septuplets accordingly in the same way.)

Lg. Flute Solo

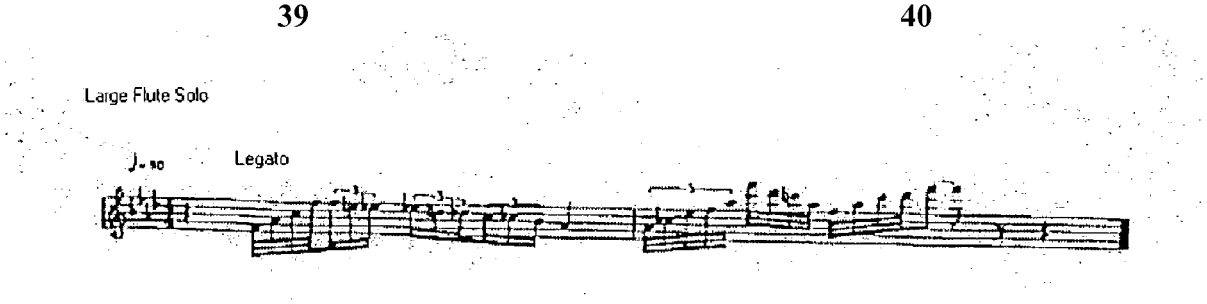
Large Flute Solo
Legato

Main Menu
- Instrument parameter
- Dynamics
- Repetition Detector
  - Fast Legato Detector
- Specials

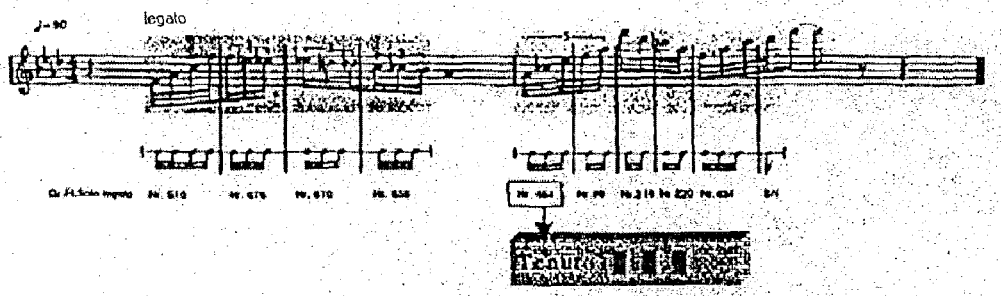
legato

The above line of music illustrates this process:

After activation, the sequencer unit scans the selected section, all suitable passages are marked, see line of music NZ. Then the sequencer unit generates a subtrack ST with only one line of music on which the tracking of the building block system is visible. Using this note image, the user can analyze how the desired fast legato sequence can be constructed from the 2-, 3-, 4-fold sequences and possibly with the aid of individual tones.

Specials Option (Specials Tool)

This option provides the user with a list of special applications, such as, e.g., the following:

| MAIN MENU | 1st LEVEL |
|---|---|
| Instrument parameter | Parameter crossfades |
| Dynamics | Ensemble combinations |
| Repetition detector | Orchestra construction set |
| Fast legato detector | |
| Specials | |

Parameter Crossfades

This function can be activated when two neighboring tones of the same pitch are to be assigned different instrument parameters.

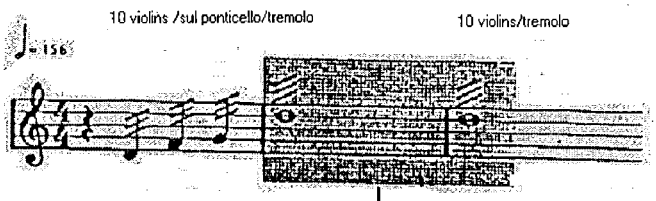
| 1st LEVEL | | 2nd LEVEL | |
|---|---|---|---|
| Parameter crossfades | → | Crossfade length | (1) 0.3s |
| Ensemble combinations | | Start offset 2nd sample | (2) 0.5 s |
| Orchestra construction set | | Save as sample | (3) |
| | | Save as instrument | (4) |
| | | Save as dynamic instrument | (5) |

Sample 1: 10 violins: "sul ponticello/tremolo"

Sample 2: 10 violins: "tremolo"

Depending on the defined length of the crossfade, the sound effect corresponds to the smooth movement of the bow during a tremolo from the violin bridge to the normal position.

If the user takes the possibilities of this tool into consideration in his programming, he can use it to generate an unlimited number of new samples.

Ensemble Combinations

The system according to the invention advantageously contains some sample lines of ensemble standard combination, thus, e.g., in unison and in octaves If the user now, for instance, selects a few violin measures and accesses the "ensemble combination" menu, a list appears of, e.g., the possible combinations "violins in octaves, 3 flutes in unison, 8 violas in unison and in octaves," and the like. If he selects one of these possibilities, the note sequence appears specially marked in the combination instrument track, i.e., marked with a reference to the respective "mother instrument."

Another option of the ENSEMBLE COMBINATION MENU can be "AUTODETECT COMBINATIONS." Here the sequencer looks for possible in unison or octave combinations, and one has the possibility of replacing them with the "ensemble samples" provided by the database.

Orchestra Construction Set

This set represents a further development of the ensemble combinations. The difference is that here they are not individual tones, but chord and rhythm sequences—from the simple final chord to special effects, such as genuine clusters or the like.

If the user activates this function, the sequencer generates its own orchestra track on which the samples can be placed, whereby two construction set variants can exist.

A) sample-based orchestra construction set:

Here the user will find pre-produced and stored stereo samples. When a sample is selected, the notation of this sample appears on the various instrument tracks, again similar to a ghost part.

B) MIDI software-based orchestra construction set:

It provides for prefabricated MIDI files. When these are placed on the orchestra track, the notation in the individual instrument tracks is "real," the user can then do some post-arranging. The user also has the possibility of generating his own construction sets and saving them.

Reverberation Filter Stereo Tracking Soft/Loud Compression Software (Reverberation Filtering Panning Compression)

The daisy-chaining between samples and sequencer can also be continued with reverberation and filter parameters. This means that the fading program knows what it is "fading." It knows about the instrument selection, performance styles, dynamic assignments and the like set via the sequencer unit at every point of the piece. With corresponding algorithms, the reverberation software recreates the harmonic merging of an orchestra that takes place in a concert hall and accordingly generates authentic-sounding sound effects. The fundamental algorithms are based, e.g., on the difference between live-sample unison combinations and combinations merged in the sequencer unit. Algorithms can thus be derived , e g., from the differential analysis of the different sounds:

Solo flute

Solo oboe

Flute—oboe in unison live

Flute—oboe combined in the sampler and these will be generated in the different instrument and dynamic combinations.

Another example can be a software for taking into account the resonance effect of a deep kettledrum beat on the double basses. The corpi of the double basses act as it were to intensify the resonance for the kettledrum. In the case of unison combinations of kettledrums and basses, an additional "sound fusion" occurs: if a kettledrum is played in an ensemble without double basses, a clear difference is noticeable in the sound spectrum of the kettledrum. As briefly outlined above, the reverberation software "knows" about the presence of any double basses or unison combinations and can take this into consideration in its sound image calculations.

An optimal reverberation filter software, best graphically oriented, is structured without complicated technical parameters essentially according to the following points:

1. The concert hall is defined by presets of the "best concert halls" in the world.
2. The orchestra is placed, i.e., the instrument floor plan is defined.
3. The listener is placed etc., e.g., from the conductor's position to the last row in the respective "hall."
4. The dynamic range is defined, e.g., from the classical CD range with little compression to the commercial dynamic with the maximum of compression.
5. The sound character is defined, e.g., from "shrill" to "very soft," by appropriate filtering and forcing the corresponding instruments and the overall sound.

Mix-Down and Dynamic Software

Mix Down Tuning:

The treatment of volume ratios of the diverse instruments and instrument groups to one another is a complex task. An ff tone of a flute is considerably softer than an ff tone of three trombones in unison. One component of the system according to the invention is therefore maintaining the natural dynamic ratios of all the instruments to one another precisely. Of course, the user is free to change them for his own purposes.

In order to attain this goal, when recording the samples a precise dynamic log is kept. The db difference between an fff drum beat and a ppp tremolo/con sordino of a solo violin is known. This information is directly incorporated into the above-mentioned instrument parameters (in the form of the "sample description parameters"). The user can depend on the volume ratios he programs corresponding to those of a genuine orchestra, or when he takes over an existing score, that the dynamic assignments correspond exactly to the composer's intentions.

If the composer now writes a piece for chamber music instruments, that is, e.g., comprising woodwinds and a small strings ensemble, this produces a dynamic headroom that is not used. In order to achieve the best possible quality in the mixing, i.e., the highest possible signal-to-noise ratio, he can optimize the piece after programming is completed with a standardizing function. The sequencer unit looks for the loudest sample of the piece and boosts all the samples upwards by the possible value. This process naturally has no effect on volume ratios and the preset dynamic values are also maintained, that is, e.g., pp samples remain pp samples.

This option is possible when the library is standardized per se. Each sample is stored at the maximum level. The volume differences logged during recording are stored in the sample volume data. This means that each sample has a volume value stored with it. Thus a fff kettledrum beat is close to zero db, a ppp solo violin at an offset of −40 db. The sequencer unit therefore only needs to check which is the highest sample volume value and which sample is closest to zero, and then accordingly adjusts all the sample volume data upwards.

In order to make optimal use of the signal-to-noise ratio in the individual audio outputs (in the case of external mix-down), the user can utilize a special standardization function that standardizes all the instruments and samples rooted in one output as a complete packet. The sequencer unit then calculates a dynamic protocol of how an external mixing console is to be adjusted in order to return to the starting values, such as, e.g., brass stereo out 1, woodwinds stereo out 2, etc.

Dynamic tuning

Another feature for dynamic control results for composers who regard the orchestrator as a score or lay-out workstation. This means composers who work for "genuine" orchestras.

This kind of composer has programmed his piece and defined all instrument parameters. He has saved the dynamic assignments for the last stage of his work. The starting point for his dynamic assignments is, e.g., a lyrical oboe solo. He likes the expression of the oboe best when it plays in the mp–mf range. He fixes this dynamic value first. Now he is faced with the question of how loud the accompaniment, figuration or bass voices should be in order to obtain the desired effect.

Now the sequencer unit offers its own dynamic tool for this purpose. The composer can thus make individual voices or selections louder or softer. The difference from a conventional "velocity control" is that the dynamic gradations of the individual sample are also included here. In our example he reduces the volume of the strings harmonies such that the oboe solo can develop to the correct degree. Since no other dynamic values apart from the oboe voice have yet been set, and the sequencer unit starts from the presets, the string dynamic corresponds at the start to about an mf. When the composer has reduced the strings until the desired sound result is achieved, they have reached, e.g., a medium pp value. The composer closes the window and the dynamic marking pp automatically appears under the strings voices. This method can, of course, also be applied to preset crescendo and decrescendo values. The composer thus has the guarantee that his dynamic marking will ultimately achieve the desired effects comparable to the concert hall.

The "dynamic control" offers the user the following possibilities for shortening and facilitating the various work processes, namely in the selection of one or more instruments or the entire range of instruments:

| DYNAMIC CONTROL | |
|---|---|
| Gradually louder | 1) |
| Gradually softer | 2) |

-continued

| DYNAMIC CONTROL | |
|---|---|
| Retain solo instrument dynamic | 3) |
| Increase solo instrument dynamic | 4) |
| Expand dynamic (expansion) | 5) |
| Reduce dynamic (compression) | 6) |
| Maximum volume | 7) |
| Minimum volume | 8) |

1), 2) Function from the above-mentioned explanation
3) Gradually reduces dynamic of all instruments "not selected".
4) Increases the dynamic of the "selected" instrument if it reaches the maximum value. Function like "retain solo instrument dynamic"
5) Oriented to the softest and loudest dynamic markings of the instrument and increases the difference gradually; the dynamic markings are automatically renewed.
6) Reverse process to "expand dynamic."
7) Oriented to the loudest dynamic marking and increases it by the corresponding possible value to the maximum level.
8) Oriented to the softest dynamic marking and reduces it by the corresponding possible value.

The following brief points will be made regarding the hardware on which the system according to the invention is based:

Memory Capacity

The audio samples organized in the bi-directional sound parameter memory unit provided according to the invention are a fixed component of the system. Using approx. 125 gigabytes, the samples are stored in a manner that cannot be directly altered by the user. Only the software of the sequencer unit itself has authorized access. The samples are still influenced by criteria such as velocity and main volume, but since the sequencer software, as with audio tracks, has the possibility of buffering the samples required in the respective piece in advance, an extremely extensive RAM memory is not necessarily a prerequisite given correspondingly fast hard disks.

A desirable minimum capacity for full use of the invention would be eight, ideally 16, stereo outputs. Since work and processing are carried out with 96 kHZ/24 Bit resolution, a further development of this data rate is obviously desirable. This requires correspondingly high quality digital transformer and requires the option of different digital out variants, i.e., of 44100, 48000 or 96000 kHz.

BRIEF DESCRIPTION OF THE DRAWINGS

The invention is explained in more detail on the basis of the drawing.

DETAILED DESCRIPTION OF THE INVENTION

Figure 1:
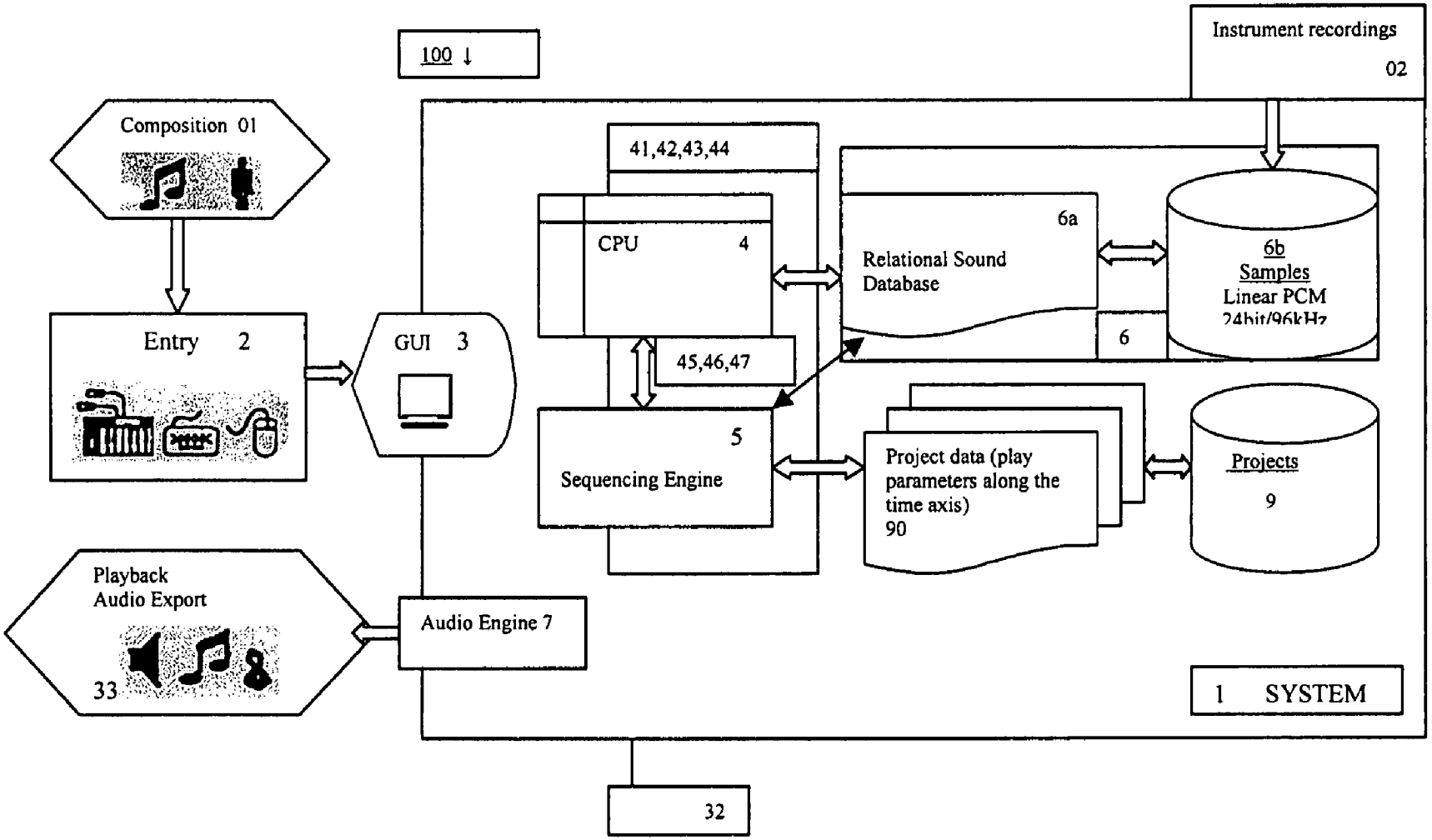
FIG. 1 shows a diagram of the new composition system.

The composition system 100 shown in FIG. 1 comprises a notation entry unit 2 that can be supplied by the user or composer with the sound sequence or composition 01 conceived by him, which is dataflow-connected with monitor to a composition computer 1 via an interface, such as, e.g., a graphical user interface (GUI) 3. Corresponding peripherals are connected to the computer, such as, e.g., a (score) printer 32. An essential component of the system 100 is an audio export system which supplies via an audio interface (audio engine) 7 an acoustic playback unit, thus, e.g., a speaker system 33 or a monitor speaker 8, which provides the acoustic playback of a just entered note, e.g., for the immediate monitoring of the sound or of a sound sequence after entering a note, a note sequence and ultimately, e.g., an entire composition.

At least one computer or processor unit (CPU) 4 and at least one sequencer unit (sequencing engine) 5 dataflow- and data exchange-connected to it are integrated into the system of the composition computer 1. An intelligent relational database 6*a*, namely the bi-directional sound parameter memory unit 6*a*, representing an essential component of the system according to the invention or the system on which it is based, containing in its memory for each one of the sound samples 61 in the library unit 6*b* all the parameters assigned to this sound, this sound sequence, this sound cluster and its/their quality, characterizing, describing and defining the same, and the data, coordinates, address information and the like necessary for locating, for accessing the sound in the sound sample library 6*b* and retrieving it, is interposed between the processor unit 4 and a sound sample library memory unit 6*b*, in which a large number of samples 61—based on recordings 02 of sounds, sound sequences, sound clusters and the like of real instruments, instrument groups, orchestras and the like—of digitalized sounds, e.g., in the form of sound frequency envelopes or the like, are stored. The two above-mentioned units 6*a* and 6*b* form the sound sampler unit 6 or are an essential part of it.

This latter new sound parameter memory unit 6*a* integrated into the system is data flow- and data exchange-connected or—networked at least to the processor unit 4 and the sequencer unit 5. The sound parameter memory unit 6*a* "knows" at all times about all of the sounds 61 stored in the sound sample library 6*b* (e.g., sound images in the form of sound envelopes in digitalized form) and about all of their intrinsic quantitative and qualitative values, it knows on which instruments a sound desired by corresponding notation inputs and with its quality parameters can be produced, whether it can be played at all on an instrument requested by the entry, etc. Due to its constantly alert, precise overview of all the sound samples 61 respectively contained in the sound sample library 6*a*, the sound parameter memory unit 6*b* is able to provide suggestions by itself for "playable" alternative instruments and/or suitable alternative sounds for sounds that cannot be played on an instrument selected by the user, and the like.

The composition computer 1 further comprises a number of different software units assigned at least to the CPU 4 and the sequencer unit 5 or program software 41 underlying them for the reproduction of the entered composition as a customary score and/or such a software 42, for checking which of the tones entered by the composer cannot be played on the instrument selected by him because of its limited tonal range and/or a software 43 for processing a sound.

The software units—and this is by no means a complete list—can be those for impressing reverberation/resonance characteristics on a sound, for dynamic changes within a sustained tone 44, for corrections to a natural sounding playback of rapid repetitive sounds of the same loudness 45 or sounds rapidly played in succession of differing loudness 46, further for adapting dynamic values of sounds of various instruments 47 to one another, and the like.

The sound images or sound samples thus corrected or processed can then be transmitted via the acoustic converter 7 as correspondingly corrected digital sound envelopes to the monitor speaker 8 or its speaker 33 and ultimately played back by it as sounds processed as desired.

Furthermore, within the computer 1 a project memory unit 9 can be supplied for saving the score, e.g., from the sequencer unit 5 via a project data unit 90 already holding the play parameters along the time axis, i.e., e.g., a processing modus for the score, from which required elements or partial pieces from previously completed and stored compositions can be retrieved at any time within the framework of a work session.

Figure 2:
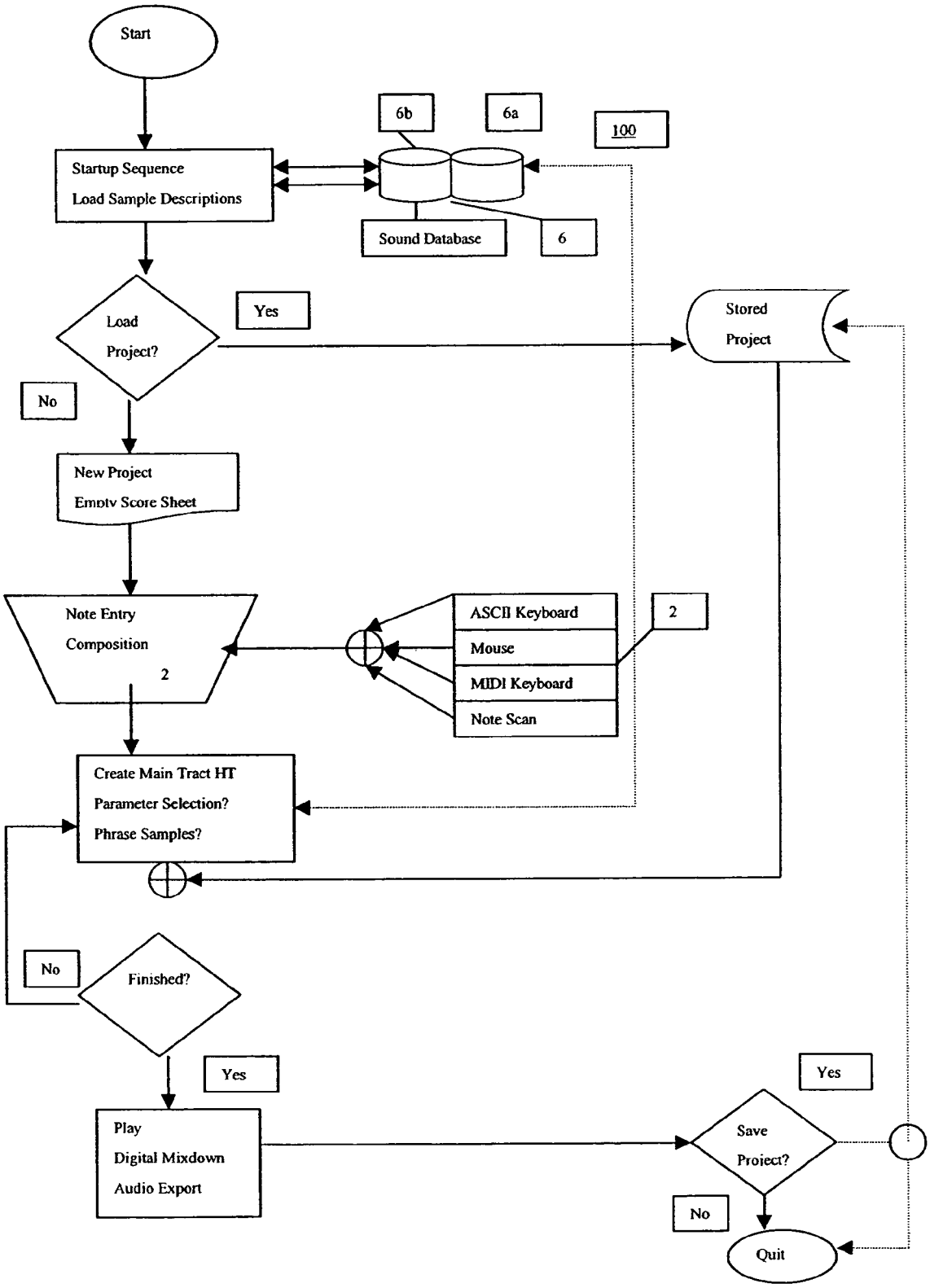
FIG. 2 shows a flow chart of the composition process.

The diagram in FIG. 2 shows how, after booting, loading with the sound definition parameters from the sound database 6 occurs, in which the sound sample parameter memory unit 6*a* and the sound sample library 6*b* storing the same are integrated.

Then there is a prompt about whether a loaded project should be stored in the project storage unit 9, which occurs when "yes" is answered. If this is not the case, hence a new project is started and thus an empty score sheet is available, the notes, punctuation, and the like, forming the note sequence, composition or the like are entered by the user, e.g., by means of notation input unit 2, such as an ASCII keyboard, mouse, MIDI keyboard, note scanning or the like.

The main track HT is then created, supplied by the bi-directional sound parameter memory unit 6*a* of the sound database 6.

Afterwards, in the event that a project that has already been stored, thus a score stored in the project memory unit 9, needs to be accessed as the basis for or to supplement the composition, the same can be taken from the project memory unit 9. After this, the user decides whether he is satisfied with the quality and the other properties of the sound entered by him or the corresponding sound sequences or the like and/or a sound sequence retrieved from the project memory unit 9. If this is not the case, there is a loop back to the processing stage, which is supplied from the sound database 6 with new parameters, processing parameters or the like, or with alternative and/or additional suggestions created there. The said prompt and control loop is repeated until the user is satisfied with the sound, with a sound sequence, or the like, continuously reviewed by him.

Now the playback, a digital mix-down, the audio export, a sheet music export or the like can occur, whereby it can be decided via a prompt whether the just completed project should be saved or not. If it should be saved, it is brought into the project memory unit 9. If this is not the case, the work session is ended.

The invention claimed is:

1. An apparatus for composing a musical composition composed of tones or sounds played on and reproduced by virtual musical instruments, which correspond to tones or sounds played on real musical instruments, said apparatus comprising:

an acoustic playback device, comprising at least one of a monitor speaker, a speaker unit, and a score printer, structured and arranged to playback the musical composition at least one of during and after completion of the musical composition;

a composition computer comprising at least one processor unit and at least one sequencer unit data flow and data exchange linked with said at least one processor unit;

at least one interface;

a notation entry unit data flow and data exchange connected and networked to said composition computer through said at least one interface;

at least one sound sampler unit, data flow and data exchange connected to said processor unit and to said sequencer unit, comprising at least one sound sample library memory unit and at least one bi-directional sound parameter memory unit data flow and data exchange connected to said at least one sound sample library memory unit;

said at least one sound sample library memory unit being structured and arranged to store recorded sound samples of all individual sounds, sound sequences, and sound clusters for each individual virtual instrument or instrument group;

said bi-directional sound parameter memory unit being structured and arranged to store all sound definition parameters associated with each stored sound sample in said at least one sound sample library memory unit in order to retrieve said stored sound samples and to transmit the retrieved stored sound samples to at least one of said at least one processor unit and said sequencer unit; and said at least one sequencer unit being structured and arranged to receive notes, note sequences, and note clusters along with either associated sound definition parameters of said notes, note sequences, and note clusters, or associated sounds, sound sequences and sound clusters of said notes, note sequences, and note clusters, and to store said notes, note sequences, and note clusters entered by said notation entry unit for playback on said acoustic playback device.

2. The apparatus in accordance with claim 1, wherein said acoustic playback device is structured and arranged to one of acoustic or scored playback of said sound samples.

3. The apparatus in accordance with claim 1, wherein said acoustic playback device is structured and arranged to reproduce the sound samples in an ensemble formation.

4. The apparatus in accordance with claim 3, wherein said ensemble formation comprises one of chamber music and orchestral formation.

5. The apparatus in accordance with claim 1, wherein said at least one interface comprises a graphical user interface.

6. The apparatus in accordance with claim 1, wherein said sound samples are digitized samples.

7. The apparatus in accordance with claim 1, wherein said bi-directional sound parameter memory unit is further structured and arranged to store and transmit sound samples one of changed in quality by processing in or having newly defined parameters input by said composition computer.

8. The apparatus in accordance with claim 1, wherein, in said bi-directional sound parameter memory unit, sound definition parameters are arranged in a hierarchal form in which groups of various instruments of an orchestra form main tracks and individual instruments of said groups form subtracks.

9. The apparatus in accordance with claim 8, wherein said subtracks are configured according to a data tree principle hierarchically in a form of individual instrument-specific sound parameter levels or sound parameter level sequences.

10. The apparatus in accordance with claim 1, wherein, in said bi-directional sound parameter memory unit, said sound definition parameters are configured according to a hierarchical principle, from the top: instrument level, instrument modus level, instrument playing styles level, first to nth playing style sublevels, sound lengths level, and sound pitch level.

11. The apparatus in accordance with claim 1, wherein, in said bi-directional sound parameter memory unit, said individual sound definition parameters, said individual sound sequences definition parameters, and said individual sound clusters definition parameters for an instrument or instrument group to be played, dynamic, repetition, fast legato, and special modes are configured with equal value in a hierarchical level next to one another, and that, within said sound definition parameters, a hierarchical configuration with main level and sub-levels is provided.

12. The apparatus in accordance with claim 1, further comprising:

at least one software unit assigned at least to said processor unit and said sequencer unit comprising software for user-friendly processing of at least one score unit or for the playback of said sound parameters, said sound sequences parameters, and said sound cluster parameters entered via said notation entry device into a conventional line of music or score through said at least one interface; and at least one tone range definer and limitation unit structured and arranged such that, when tones or sounds are entered via said notation entry unit that cannot be played on an assigned individual instrument or that are too low or too high for the assigned instrument, a warning prompt is provided to at least one of said notation entry unit and said at least one interface.

13. The apparatus in accordance with claim 1, further comprising:

at least one sound processing unit structured and arranged for a performing a desired change or processing of said sound images or samples accessed from and transmitted by said sample library memory unit;

at least one dynamic unit structured and arranged for changing a dynamic within a tone or sound or sound cluster, including within a sustained tone or sound or sound cluster, wherein at least one of said at least one sound processing unit and said at least one dynamic unit are assigned to said processor unit and said sequencer unit.

14. The apparatus in accordance with claim 13, wherein said at least one sound processing unit is structured to detect individually matched impressions on a respective instrument of at least one of reverberation characteristics, echo characteristics, and timbre characteristics.

15. An apparatus for composing a musical composition composed of tones or sounds played on and reproduced by virtual musical instruments, which correspond to tones or sounds played on real musical instruments, said apparatus comprising:

an acoustic playback device, comprising at least one of a monitor speaker, a speaker unit, and a score printer, structured and arranged to playback the musical composition at least one of during and after completion of the musical composition;

a composition computer comprising at least one processor unit and at least one sequencer unit data flow and data exchange linked with said at least one processor unit;

at least one interface;

a notation entry unit data flow and data exchange connected and networked to said composition computer through said at least one interface;

at least one sound sampler unit, data flow and data exchange connected to said processor unit and to said sequencer unit, comprising at least one sound sample library memory unit and at least one bi-directional sound parameter memory unit data flow and data exchange connected to said at least one sound sample library memory unit;

said at least one sound sample library memory unit being structured and arranged to store recorded sound samples of all individual sounds, sound sequences, and sound clusters for each individual virtual instrument or instrument group;

said bi-directional sound parameter memory unit being structured and arranged to store all sound definition parameters associated with each stored sound sample in said at least one sound sample library memory unit in order to retrieve said stored sound samples and to transmit the retrieved stored sound samples to at least one of said at least one processor unit and said sequencer unit;

said at least one sequencer unit being structured and arranged to receive notes, note sequences, and note clusters alone with either associated sound definition parameters of said notes, note sequences, and note clusters, or associated sounds, sound sequences and sound clusters of said notes, note sequences, and note clusters, and to store said notes, note sequences, and note clusters entered by said notation entry unit for playback on said acoustic playback device; and further comprising at least one of:

at least one repetition detection unit structured to adjust an audio impression of tones or sounds of a same pitch played in rapid succession on a respective virtual instrument to an audio impression of a sound repetition played on a real instrument;

at least one fast legato unit structured to adjust an audio impression of tones or sounds of different pitches played in rapid succession on a respective virtual instrument to an audio impression of a such a rapid sequence of tones or sounds played on a real instrument; and at least one dynamic adaptation unit structured to tune various volumes or volume ranges of individual virtual instruments to one another when said individual virtual instruments are to be played together, said dynamic adaptation unit comprising sound volume parameters defining maximum and minimum volumes or volume ranges individually achievable by real instruments corresponding to said virtual instruments, wherein the at least one unit is assigned at least to said processor unit and to said sequencer unit.

16. An apparatus for composing a musical composition, composed of tones, tonal sequences, tone clusters, sounds, sound sequences, sound phrases, musical works, for the acoustic or other reproduction by a plurality of virtual musical instruments corresponding to real musical instruments, said apparatus comprising:

at least one notation entry unit for at least one of:

(A) entry of notes on which tones or sounds to be played are based, as well as sound parameters of the entered notes assigned by the composer, which describe or define the notes with regard to characteristics comprising at least one of a type of instrument or instrument group to be played, pitch, tone length, dynamic, and playing style; and (B) entry of at least one of sound sequences and sound sequence parameters describing the sound sequences and sound clusters and sound cluster parameters describing the sound clusters;

a sound parameter memory;

a sequencer unit data and flow connected to said sound parameter memory;

said notation entry unit being structured and arranged to enter and save the at least one of the notes, sound sequences, and sound clusters and their assigned parameters in said sound parameter memory and said sequencer unit;

an acoustic playback unit structured and arranged to produce sounds created during composition, playing, and playback of stored sound sequences;

a sound sample library memory unit, comprising sound images or samples of all individual sounds, sound sequences, sound clusters of the individual virtual instruments or instrument groups and their assigned parameters, parameter constellations, and parameter combinations, data-flow connected to said sound sequencer unit;

said sound parameter memory and said sequencer unit being structured and arranged to at least one of direct, access, and activate the sound images or samples corresponding to an entered sound definition parameters;

an acoustic transformer structured and arranged to transmit the sound images or samples from said sound sample library memory unit to said acoustic playback unit.

17. The apparatus in accordance with claim 16, wherein said acoustic playback unit comprises one of a speaker unit or monitor speaker.

18. The apparatus in accordance with claim 16, wherein said sound parameter memory comprises a composition computer or a software program.

19. The apparatus in accordance with claim 16, wherein said acoustic transformer comprises a digital transformer or an analog transformer.

20. The apparatus in accordance with claim 16, wherein the sound samples are stored in said sound sample library memory unit in digital form.

* * * * *